United States Patent [19]

Hagen et al.

[11] 3,942,677

[45] Mar. 9, 1976

[54] CLOSURES FOR VESSELS

[75] Inventors: Reinold Hagen; Peter Giese, both of Bonn-Holzlar; Peter Klüsener, Bonn-Bad Godesberg, all of Germany

[73] Assignee: Kautex-Werke Reinold Hagen GmbH, Bonn-Holzlar, Germany

[22] Filed: Mar. 13, 1974

[21] Appl. No.: 450,728

[52] U.S. Cl. ..... 220/304; 220/321; 215/272

[51] Int. Cl.[2] ..... B65D 45/34

[58] Field of Search ..... 220/309, 320, 308, 295, 220/296, 298, 304; 215/272

[56] References Cited

UNITED STATES PATENTS

| | | | |
|---|---|---|---|
| 3,446,391 | 5/1969 | Yates | 220/308 |
| 3,499,574 | 3/1970 | Yates | 220/308 |
| 3,510,023 | 5/1970 | Ullman | 220/320 |
| 3,561,637 | 2/1971 | McConnell | 220/320 |
| 3,642,166 | 2/1972 | Starr | 220/320 |
| 3,664,544 | 5/1972 | Hammes | 220/308 |
| 3,792,797 | 2/1974 | Mrusek | 220/308 |

*Primary Examiner*—Donald F. Norton
*Attorney, Agent, or Firm*—Laurence R. Brown

[57] ABSTRACT

A closure adapted to be applied to a neck of a vessel or container so as to seal a comparatively wide mouth in said neck has a rim or skirt which is divided up into a plurality of sections by slits between the sections depending from a lid portion of the closure and a stressing or tensioning band placed around the rim, the arrangement being such that there is at most only slight engagement between corresponding screw threads or the like on the neck and in the skirt when the closure is applied to the neck, full sealing engagement between the said screw threads being produced by tensioning of said band after the closure is in position on the neck, such tensioning causing the initially radially outwardly splayed said sections to be pulled radially inwardly on to the neck. The vessel and closure are preferably of thermoplastic material. Preferably tensioning of said band also causes the closure to move axially into more intimate contact with the vessel to compress a sealing ring and thereby improve the seal therebetween.

31 Claims, 9 Drawing Figures

FIG. 1
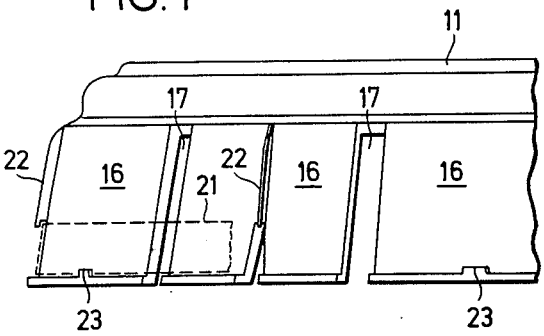
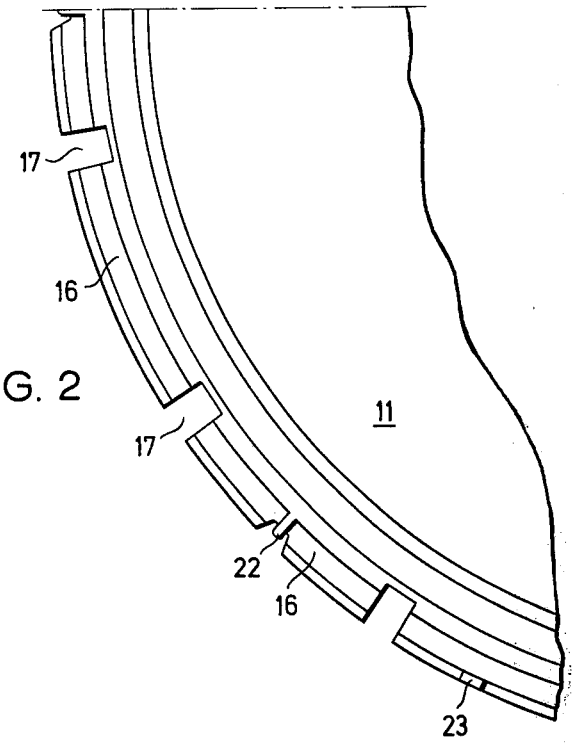
FIG. 2

FIG. 3
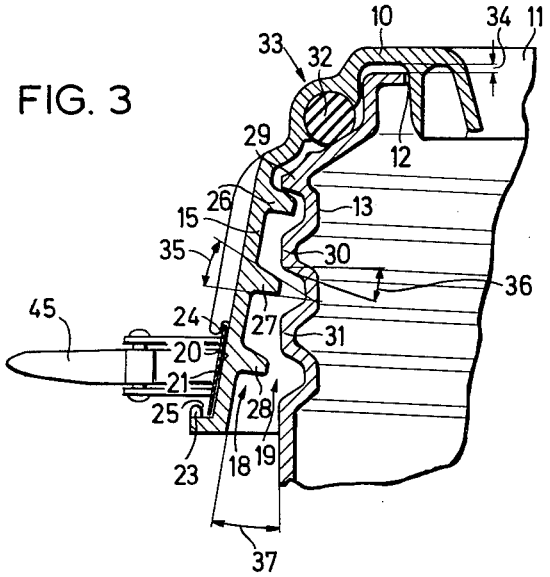
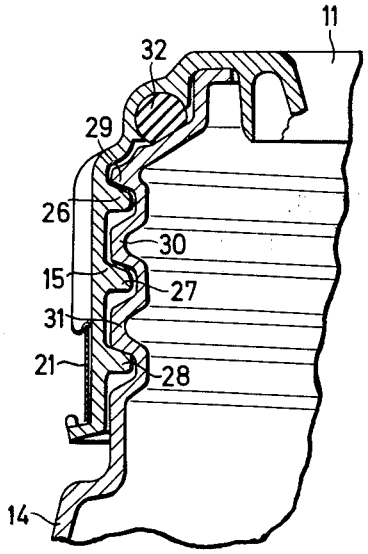
FIG. 4

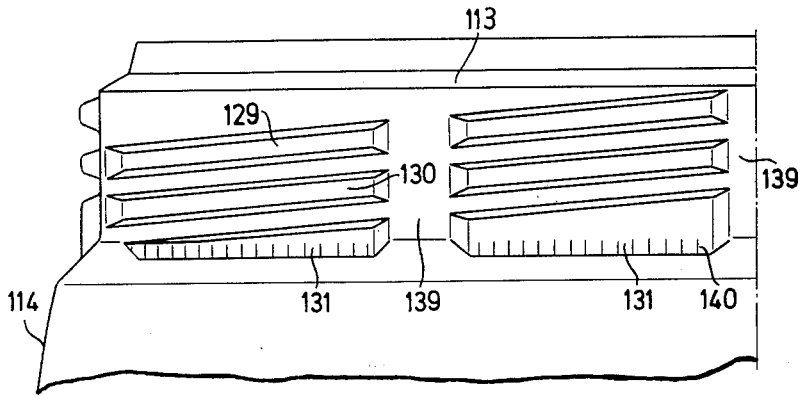
FIG. 5
FIG. 6
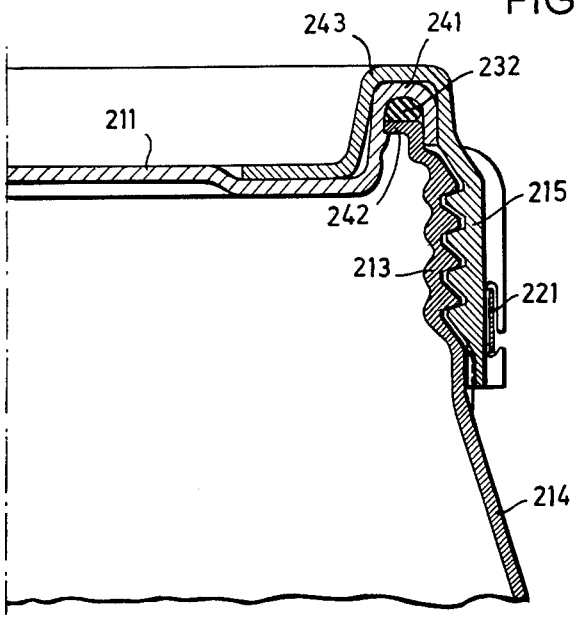

FIG. 8
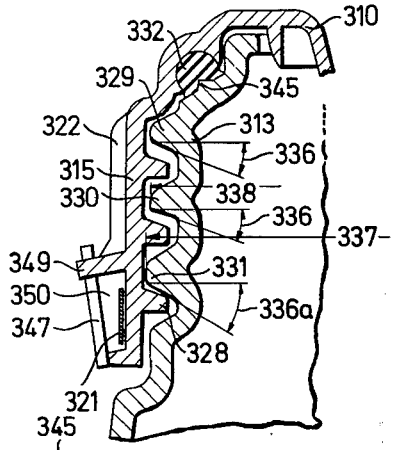
FIG. 7
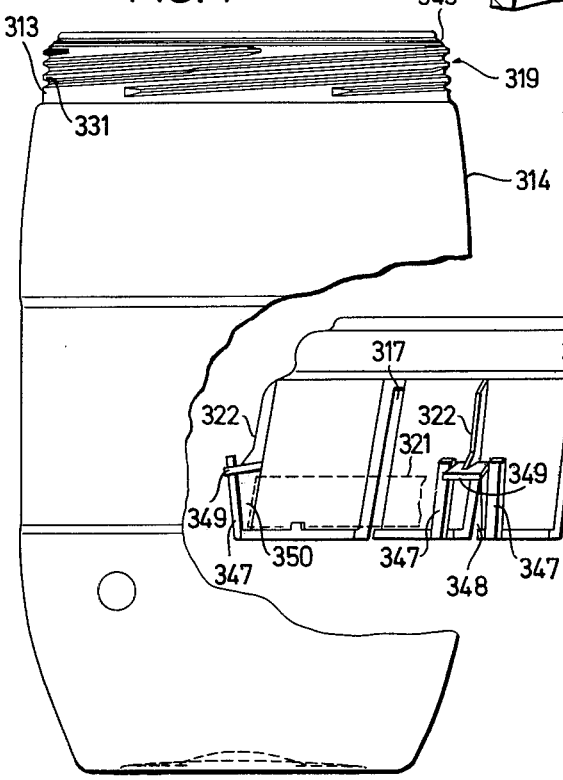
FIG. 9

CLOSURES FOR VESSELS

The invention relates to a closure device applied to a wide necked vessel preferably consisting of a thermoplastic material and having a closure cap consisting of a lid portion and a rim, its rim consisting of a thermoplastic material, being sub-divided into sections, forming a positive fit with the marginal region (neck) surrounding the mouth of the vessel and being secured in this position by stressing means, preferably in the form of a stressing band.

The designation "wide necked vessel" in this context means a container having a relatively large mouth, viz. by contrast with a vessel in which the mouth is very small, e.g. defining a bung-hole. The margin surrounding the mouth of the vessel will hereinafter be referred to as the "neck" throughout, but this expression is not intended to impart any limitation.

Known closure devices of the kind hereinbefore described have the disadvantage that the rim of the closure cap has to be splayed when it is applied to and removed from the vessel. This is possible by reason of the elastic deformability of the rim or of sections forming it, since the rim or the sections consist of thermoplastic material. On the other hand it is, however, necessary to apply considerable forces for the purpose of elastically deforming the rim, so that manipulation of the closure cap causes difficulties.

A closure device of thermoplastic material for wide necked vessels is also known, in which the rim of the closure cap consists of a plurality of separate claw-shaped parts, which are threaded on to a wire or the like and loosely connected to the lid portion proper. The manufacture of this closure is extremely complicated and therefore expensive, without any appreciable improvement in its durability.

Furthermore, it is known to provide closure devices of thermoplastic material with a screw thread, so that the closure cap can be screwed in the usual way on to or into the neck of the vessel which is also provided with a screw thread.

In the case of wide necked vessels such a closure, which is applied solely by a screwing operation, has the disadvantage that it generally requires a very large torque, which inter alia is also caused or increased by the sealing ring, which is generally required, and by dirt and the like. Moreover in the case of wide necked vessels such a screw closure has the general disadvantage that it requires relatively close tolerances to be maintained. Thereby the cost of manufacture of the vessel or container can be increased.

It is an object of the invention to construct a closure device of the kind hereinbefore described in such a way that the vessel can be securely and sealingly closed by means which are simple to manufacture and manipulate. Moreover the closure device should be capable of coping with all normal stresses without the latter causing any difficulties or disadvantages.

For the purpose of fulfilling this object, the invention proposes that the rim of the closure cap is splayed outwardly relative to the neck in an unstressed condition, that the projections, indentations or the like on the inside of the rim which, when the rim is stressed, effect the positive fit and are constructed to define screw threads or thread sections do not come into engagement with the corresponding projections, indentations or the like (threads) on the neck or do so only over a portion of the height of the rim and/or do so loosely. These portions of the rim and of the neck which effect the positive fit will hereinafter throughout be referred to as a "thread" or "thread sections" without thereby intending to impart any limitation as to the configuration of these projections, indentations or the like.

The stressing means is desirably in the form of a stressing band. It is moreover advantageous to provide that, when the rim is unstressed, the thread section(s) which are close to the lid portion come into loose engagement with the thread section(s) of the neck. Furthermore, the arrangement may be such that the unstressed rim is radially outwardly splayed relative to the neck by a dimension such that the thread sections which are located at the terminal region of the neck which faces away from the lid portion are not in engagement with the corresponding thread sections of the neck.

The invention is based on the realisation that the prestressing of the individual rim sections in the case of the known snap-action closures, which makes their manipulation for the purpose of applying and removing them so difficult, is superfluous from the point of view of the closure function since, despite the positive fit between the rim sections and the neck of the vessel, it is necessary additionally to apply a stressing means, e.g. a stressing band, which secures the closure cap in position and possibly also additionally stresses it. Thus the invention dispenses entirely or at least substantially with a positive fit between the closure cap and the neck, before the stressing means has been stressed. Instead the final positive fit is not effected until the rim is pressed radially inwardly against the neck.

In a particularly advantageous embodiment of the invention the closure cap is applied to the neck by an initial short screw movement, a relatively short screw movement being adequate, since this screwing-on of the cap does not represent the final securement proper, but merely a form of provisional application, viz. with the aim of bringing the lid into the correct position for stressing the stressing means. It is also perfectly possible, instead of loosely screwing on the cap, to push the latter, by deforming both parts — the rim and the neck — on to threads or thread sections on the neck, only moderate elastic deformation being required for this purpose. The extent of this deformation is that which is necessary for the purpose of bringing the lid into the initial position for stressing the stressing means. Overall, the closure device in accordance with the invention is exceptionally easy to manipulate; it is by no means more expensive to manufacture than known closure devices all of which are so-called snapaction closures. By comparison with the known closure already mentioned by way of introduction, which is made up of a plurality of separate parts, the closure device according to the invention has the advantage of being exceptionally simple and therefore cheap.

Furthermore the invention envisages the possibility of making the inter-engaging threads or thread sections on the rim and the neck of such configuration that an axial displacement of the closure cap takes place in the direction of the body of the wide necked vessel when the rim is radially stressed, whereby simultaneously the seal is provided with the necessary degree of prestressing for the desired sealing effect. The axial displacement can be produced by regions of the rim thread on the one hand and of the neck thread on the other hand being disposed in a relatively displaced relationship, e.g. in such a way that, when the stressing means is in the open condition, the threads or thread sections facing away from the lid portion and, when the stressing means is in the closed condition, the threads or thread sections facing the lid portion, are disposed in a somewhat relatively displaced relationship. It is moreover possible to select the flank angle of the threads or thread sections in such a way that a force component acting in the axial direction acts on the closure cap when the threads or thread sections inter-engage as a result of stressing of the rim; at least one of the threads or thread sections which form a positive fit when the rim is stressed may have a larger flank angle. It may also be desirable for at least one of the threads or thread sections which form a positive fit when the rim is stressed to have a larger external diameter. The thread or thread section with the larger diameter and/or with the larger flank angle may be provided on the vessel and/or on the closure cap.

Advantageously the stressing means is arranged in that region of the prestressed rim in which the threads or thread sections of the rim and of the neck form a positive relative fit.

It may also be appropriate to sub-divide the threads or thread sections on the neck of the vessel into sections, a neck region extending substantially axially in the longitudinal section of the neck being disposed between each section. In this way it is intended to strengthen the neck, since in general the threads or the like on the neck do not increase the wall thickness, but instead are created by appropriate profiling of the neck. This may particularly be the case where the vessel is made of thermoplastic material by a blowing process. There is then the possibility of the neck being of inadequate stability for certain stresses. This may, for example, cause the neck to become deformed in bellows-like manner, particularly under severe axial stress. This possibility will have to be taken into account particularly where filled vessels of this kind are stacked one on top of the other. Although such deformations do not cause damage to the vessel, it is nonetheless desirable to prevent them or to reduce them to a minimum. The stiffening of the neck referred to above serves this purpose.

It is furthermore possible to provide for the thread section(s) or the like which effect the positive fit when the rim is stressed, to have a rifling, rough surface, tooth configuration or the like on the rim and/or the neck, which effects a positive or a friction fit. This constitutes securement against angular displacement, which is intended to prevent any involuntary release of the closure. This will always be of advantage where the portions of the rim and of the neck which effect the positive fit are in the form of a thread. Another possibility consists in providing a rim which is corrugated or provided with a tooth configuration or the like at or in the vicinity of its free end, which co-operates with a correspondingly constructed tooth configuration or the like on the vessel so as to form a positive or friction fit therewith.

In accordance with a further proposal of the invention, the closure cap and/or the neck may be provided with one or more projections which "penetrate" into the cross-section of the sealing ring when the rim is stressed. This is intended to mean that the cross-section of the sealing ring is subjected to a deformation which results in a kind of positive fit between the sealing ring and the closure cap and/or the neck. The projection may be in the form of at least one circumferential protruding strip.

There is also the further possibility of providing the neck and/or the rim of the closure cap with retaining means for the stressing means; the neck and/or the rim may have bridges, beads or the like, which are provided with rear recesses behind which the marginal regions of the stressing means engage. The bridges and beads are advantageously arranged in relatively axially displaced relationship. The bridges in particular may serve the additional purpose of stiffening the separate rim sections, where appropriate for the purpose of avoiding any substantial deformation of the rim sections. It is also possible to provide the rim of the closure cap with strip- or pin-shaped projections which are arranged in pairs and which are associated with a bridge or the like which is disposed in the region of the rim thereabove, at least its lower terminal region extending loosely between the two pin-or strip-shaped projections of a pair of these projections. For the purpose of applying or removing the stressing means, the pin-shaped projections may be bent to an extent such that they are disengaged from the bridge. Desirably the projections of a pair are arranged on either side of an incision in the rim.

It is also possible to make the lid portion on the one hand and the rim portion on the other hand relatively separate parts, the rim being provided with a continuous and integral extension which overlaps the boundary wall of the neck mouth and the rim of the lid portion at that one of its ends which faces away from the vessel. Although this embodiment is somewhat more elaborate than the integral closure, it has the advantage that the lid portion proper which cooperates with the sealing ring normally provided does not rotate at all, so that consequently the only stress acting on the seal which is left is a compressive one in the axial direction. On the other hand the two-part embodiment of the closure according to the invention is still considerably simpler and cheaper than that known closure in which each rim section constitutes a separate part requiring to be manufactured separately. Where the lid portion and the rim are relatively separate parts, it is possible to make them of different materials. The rim portion will consist of a thermoplastic material, whilst a different material may be used for the lid portion. In an integral closure cap on the other hand the entire cap is normally made of thermoplastic material.

Desirably the arrangement is such that the closure lever of the stressing band extends substantially radially from the rim when in the opened condition and is suitable for use as a grip for engagement or disengagement of the screw connection. It may also be desirable to have the sections of the rim somewhat prestressed radially inwardly even when the stressing means is opened.

In the drawing several embodiments of the invention are shown:

FIG. 1 shows the side view of a closure cap for wide necked vessels,

FIG. 2 shows the corresponding plan,

FIG. 3 shows a longitudinal section through the neck of a wide necked vessel with a closure cap screwed thereon, in the unstressed condition, FIG. 4 shows a view corresponding to FIG. 3 with the parts in the stressed condition, FIG. 5 shows the side view of a second embodiment of a wide necked vessel, FIG. 6 shows a view corresponding to FIG. 4 of a further embodiment with a two-part closure cap, FIG. 7 shows the side view of a wide necked vessel without any closure cap, FIG. 8 shows a longitudinal section through the neck of the wide necked vessel according to FIG. 7 with a closure cap applied thereto in the stressed condition.

FIG. 9 shows the side view of the closure cap according to FIG. 8.

The closure cap 10 shown in FIGS. 1–4 consists of a lid portion 11 which closes the mouth 12 at the upper end of the neck 13 of a wide necked vessel 14, and a rim 15 which is integrally connected to the lid portion 11 and which consists of a plurality of sections 16 separated from each other by slits 17. In the closure cap applied to the wide necked vessel 14 the rim 15 of the former overlaps the neck of the vessel 14.

FIGS. 3 and 4 show that the rim 15 is provided with an internal screw thread 18 and the neck 13 with an external screw thread 19. Externally the rim 15 is provided with retaining means or a guide for a stressing band. This retaining means or guide 20 consists basically of bridges 22 and beads 23, which are arranged relatively spaced externally around the circumference of the rim 15 and which are provided with rear recesses 24, 25 or which form such rear recesses, behind which the stressing band 21 engages.

In FIG. 3 it can be seen that, in its unstressed condition, i.e., with the stressing band 21 loose, the rim 15 of the closure cap 10 extends outwardly away from the neck 13 in such a way that the individual sections 16 are outwardly splayed. Consequently, of the three thread sections 26, 27, 28 of the rim 15 and of the thread sections 29, 30 and 31 of the neck 13 seen in the view shown in FIG. 3, only the thread sections 26 and 29 are relatively engaged. The reason for this is initially when the closure cap 10 is loosely applied and the rim 15 extends outwardly, the thread section 26 of the rim 15 can merely engage the upper thread section 29 of the neck 13 by a screwing operation in the usual way, only a loose engagement being involved. From this it follows that the formation of this first positive fit by screwing does not require any major exertion. Loosely screwing the closure cap 10 on to the neck 13 does not require a large torque.

After the closure cap 10 has been provisionally applied by screwing together the two thread sections 26 and 29 (FIG. 3) the stressing band 21, which until then was loose, is tensioned, whereby the rim 15, viz. the sections 16 defining it, are drawn radially inwardly against the neck 13 of the wide necked vessel 14. This means that in the result the individual sections 16 perform a kind of pivotal movement, the "pivot" being approximately in the region 33, i.e., at the transition from the rim 15 to the lid portion 11 proper. The lower thread sections 27 and 28 on the one hand, as well as 30 and 31 on the other hand, come into engagement, but not in the course of a screwing movement, but rather merely by reason of the above-mentioned drawing together of the sections 16, which results in radially inwardly directed stressing of the rim 15, until portions of the interior surface of the rim 15 become contiguous with portions of the exterior surface of the neck 13.

The rim 15 is stressed in this way by utilising the elastic deformability of the closure cap consisting of thermoplastic material. Conversely, the consequence of releasing the stressing band 21 is that the sections 16 of the rim 15 again become outwardly splayed from the position shown in FIG. 4 of the drawing into that according to FIG. 3 so that again only a relatively small angular displacement of the closure cap 10 relative to the neck is required to cause the thread sections 26 and 29 which are still loosely engaged to become disengaged.

Clearly the arrangement may be modified from that according to FIGS. 1–4 in such a way that more than one thread section is in engagement at any one time or the thread is in the form of a multi-start thread.

A comparison between FIGS. 3 and 4 shows moreover that, in the course of stressing the rim 15, the closure cap 10 is subjected to an axial displacement in the direction of the body of the wide necked vessel 14. In FIG. 3 of the drawing the extent of this displacement is indicated at 34. The consequence of the latter is that, in the course of the stressing of the rim 15, the sealing ring 32 is subjected to a compression which effects the final sealing of the closure. This, i.e., the compression of the sealing ring caused by stressing of the rim, is also significant, because it is thereby made possible to effect the initial provisional connection by screwing the closure cap 10 on to the neck 13 with no or only slight prestressing of the sealing ring 32, so that correspondingly the sealing ring 32 is also subjected to only a slight frictional load and the torque required for producing the screw connection can be kept low.

The axial displacement of the closure cap 10 by the dimension 34 may be determined by the choice of the flank angles 35 and/or 36 and of the angle of splay 37. The latter determines the distance by which the rim 15 is pivoted in the direction of the bottle neck when stressing the stressing band 21. The larger the flank angles and the angle of splay, the larger also is the extent of the axial movement 34 which occurs when stressing the rim 15.

Another possible way of achieving the above-mentioned axial displacement of the closure cap 10 when stressing the rim 15 consists in arranging in relatively displaced disposition regions of the rim thread 18 on the one hand and regions of the thread 19 on the neck 13 on the other hand. When the closure cap is initially screwed on, the effect of the displacement is such that only the upper thread sections come into relative engagement. It is only when the sections 16 are stressed, that the displacement of the lower thread sections causes the closure cap 10 to become displaced downwardly in the direction of the body of the wide necked vessel 14 by a predetermined amount.

As a result of the axial displacement the thread sections of the closure cap 10 and of the neck 13, which are initially in engagement during the screwing-on operation, are able to become disengaged. This can be seen in FIG. 4 of the drawing, in which the two thread sections 26 and 29 are no longer contiguous after stressing of the rim 15 by the stressing band 21. In practice the positive fit is now only defined by the lower portions 28 and 31 of the threads. Clearly the arrangement shown in FIG. 4 could be modified such that a plurality of portions or sections of the threads are relatively engaged when the rim is stressed. It is also possible to provide simple strips or grooves — extending around the whole or part of the circumference — instead of a screw thread in the region of the rim 15 and of the next 13 facing away from the lid portion 11 proper. What is decisive is that stressing of the sections 16 causes a positive fit between the rim 15 of the closure cap 10 on the one hand and the neck 13 of the wide necked vessel on the other hand to be created. In this connection it is desirable to arrange the stressing means 11 in that region of the rim 15 of the closure cap 10 in which the effective positive fit with the neck 14 takes place.

It can be seen from FIGS. 3 and 4 of the drawing, that the bottle neck has a profile appropriate to the portions or sections of the screw thread. In order nevertheless to give the bottle neck the necessary rigidity — even in the case of thin walled containers —, it may, in accordance with the embodiment shown in FIG. 5, be advantageous to provide the thread portions or the like 129, 130 with gaps 139, in the region of which the well of the neck 113 of the wide necked vessel 114 extends substantially linearly in longitudinal section. In other respects the embodiment of FIG. 5 may be the same as that according to FIGS. 1 – 4.

The arrangement may moreover be such that the ability of the closure cap — irrespective of its construction in other respects — to rotate relative to the neck 13, 113 respectively is reduced by a positive or a friction fit in the stressed condition of the rim 15. This is of importance particularly where the portions or the like which effect the positive fit are defined by screw threads. Particularly in the case of multi-start threads, it is possible that the self-retentive property of the thread is relatively low even when the rim is in its stressed condition. Under unfavourable loading conditions loosening of the closure may then take place. In order to prevent this, the lower thread section 131 in the embodiment according to FIG. 5 is, for example, provided with a kind of tooth configuration 140. The thread section of the cap which in the stressed condition of the lid rim cooperates with this thread section 131 is also provided with a corresponding tooth configuration, which results in a positive fit which prevents any rotation of the lid. This effect, i.e., securement against rotation, may also be achieved by providing beads, corrugations or the like at the free margin of the closure cap. In general the arrangement has to be such that such corrugations, beads, tooth configurations or the like do not impede the provisional application of the lid which is initially caused by screwing it on, since, as shown in FIG. 3, the thread portions causing the positive fit in the stressed condition of the rim are, during the screwing-on operation, not yet or at any rate not to any substantial degree in relative engagement.

In the embodiment according to FIG. 6 the closure consisting of the lid portion 211 on the one hand and the rim portion 215 on the other hand is of two-part construction. The external circumferential region 241 of the lid portion 211 has a U-shaped profile, this region 241 overlapping the free end 242 of the neck 213 of the wide necked vessel. A sealing ring 232 is arranged between the U-shaped circumferential region 241 of the lid portion 211 and the region in the vicinity of the free end 242.

The rim portion 215 in turn is provided with a circumferential extension 243, which also has a U-shaped profile and which overlaps the U-shaped marginal region 241 of the lid portion 211. So far as the rim portion 215 is concerned, the arrangement corresponds to the embodiment according to FIGS. 1 – 4. This means that in the unstressed condition of the rim portion 215 its sections are splayed outwardly relative to the neck 213 and that it is only in the stressed condition effected by a stressing means 221 that they are pressed radially inwardly against the neck 213, so that a positive fit between the two screw threads or the like located inside the rim portion 215 and externally of the neck 213 results. The advantage of the arrangement according to FIG. 6 consists in the fact that the lid portion can be applied to the neck 213 and the region adjacent the free end 242 of the latter, with the sealing ring 232 therebetween, without any screwing operation, whereupon the loose rim portion 215 is then pushed over the outer circumferential region of the lid portion 211 and secured in the usual manner by a stressing means. Here also it is advantageous to effect a degree of axial displacement of the stressing member 215 in the direction of the body of the wide necked vessel, so as to achieve a possibly necessary degree of pretensioning of the sealing ring 232.

The invention also envisages the possibility of interconnecting the lid portion 211 and the rim portion 215 positively yet relatively rotatably, from the start, so that with this embodiment also merely an integral closure has to be manipulated.

The embodiment according to FIGS. 7 – 9 agrees in its essential parts with the embodiment according to FIGS. 1 – 4. One difference consists in the fact that the neck 313 of the vessel 314 which is provided with a four-start screw thread 319 has, in the region of the sealing ring 323, an outwardly projecting circumferential strip 345, which deforms the sealing ring 332 when the rim 315 of the closure cap 310 is in the stressed condition. By reason of the additional compression of the ring 332 caused thereby the sealing effect is improved. The strip 345 moreover provides a fixture for the ring 332, so that even if the cap 310 is subjected to any blows, impact or the like, the danger of any displacement of the sealing ring and consequent reduction in the sealing effect is eliminated.

Furthermore in the embodiment according to FIGS. 3 – 9 the flank angle **336*a* as well as the external diameter 337 of the lower thread section 331 are larger than the flank angle 336 and the external diameter 338 of the other thread sections 329, 330 of the neck 313. What is achieved by this configuration is that the extent to which the closure cap is pulled down axially when the stress band 321 is stressed is larger than the corresponding axial displacement 34 (FIG. 3) in the embodiment according to FIGS. 1 – 4. Additionally, by reason of the larger diameter of the lower thread section 331, a greater depth of engagement between the thread section 331 of the neck 313 and the thread section 328 of the cap 310 is achieved (FIG. 8**).

In the embodiment according to FIGS. 7 – 9, the retaining means or guide for the stressing band 321 consists basically of relatively spaced bridges 322 applied externally over the circumference of the rim 315, and of pin-shaped extensions 347 which extend upwardly from the lower end of the rim 315 and which are applied to the rim 315 in pairs. The arrangement is such that the bridges 322 define extensions of the shorter slits 348, which alternate with longer slits 317 in the rim 315. On either side of a slit 348 a pin-shaped projection 347 is provided. The lower ends of the bridges 322 are provided with an outwardly protruding projection 349. The dimensions of the bridges 322 and of the projections 349 on the one hand and the related pins 348 on the other hand are so chosen that the lower end of the bridge 322 concerned and the associated projection 349 engage between the upper terminal regions of the pins 347 disposed on either side of a slit 348. In this way a closed retaining means is formed for the stressing band 321. The latter can be inserted, i.e., so to speak threaded, circumferentially into the guide 350 bounded by the pins 347, the projection 349 and the lower region of the rim 315. For the purpose of inserting the stressing band 321 into the guide 350, it is however also possible to bend the pins, strips or the like 347 outwardly to a certain extent, so that the stressing band 321 can be inserted into the guide or retaining means 350 from above between the pins 347 and the projection 349. Such bending of the pins or strips 347 is possible without difficulty by reason of the elasticity inherent in the thermoplastic material. The projections 347 then spring back into the position shown in FIGS. 8 and 9.

We claim:

1. The combination of a vessel having a mouth in a marginal region of said vessel, a closure and selectively engageable stressing means associated with said closure for causing said closure to seal said mouth, said closure having a lid portion and a rim depending from said lid portion, relatively interengageable projections and recesses being provided on said marginal region and in said rim, said rim being sub-divided into sections forming a positive fit with said marginal region between said interengageable projections and recesses when said closure is secured to said marginal region by stressing of said stressing means, and said rim sections being, when not stressed by said stressing means, splayed radially outwardly relative to said marginal region such that said projections and recesses are in relative engagement at most loosely over only a portion of the height of said rim.

2. The combination of claim 1, wherein said stressing means is defined by a stressing band.

3. The combination of claim 1, wherein said interengageable projections and recesses define thread sections and wherein, when said rim is unstressed, those of said thread sections of said rim which are close to said lid portion come into loose engagement with said thread sections of said marginal region.

4. The combination of claim 3, wherein said rim, when unstressed by said stressing means, is radially outwardly splayed relative to said marginal region by a dimension such that said thread sections of said rim which are disposed at a terminal portion of said marginal region which faces away from said lid portion are at most in loose engagement with corresponding said thread sections of said marginal region.

5. The combination of claim 3, wherein said thread sections in said rim and on said marginal region are multi-start thread sections.

6. The combination of claim 3, wherein said thread sections in said rim and on said marginal region are such that when said rim is radially stressed by said stressing means, said closure is axially displaced towards said vessel.

7. The combination of claim 6, wherein regions of said thread sections in said rim are disposed in a relatively displaced relationship with said thread sections on said marginal region.

8. The combination of claim 6, wherein flank angles of said thread sections are such that a force component acts on said closure in the axial direction of the mouth when said thread sections interengage as a result of stressing of said rim by said stressing means.

9. The combination of claim 8, wherein at least one of said thread sections has a larger flank angle than other ones of said thread sections.

10. The combination of claim 9, wherein said thread section having a larger flank angle is a thread section on said marginal region.

11. The combination of claim 3, wherein at least one of said thread sections has a larger external diameter than other ones of said thread sections.

12. The combination of claim 11, wherein said thread section having a larger external diameter is a thread section on said marginal region.

13. The combination of claim 3, wherein said stressing means is arranged in a region of said rim in which said thread sections of said rim and of said marginal region form a positive relative fit.

14. The combination of claim 3, wherein said thread sections on said marginal region are sub-divided into sections and a portion of said marginal region extends substantially axially of said marginal region between adjacent ones of said portions.

15. The combination of claim 1, wherein at least some of said interengageable projections and recesses are provided with ridges to produce a friction effect.

16. The combination of claim 1, wherein the free end of said rim and said marginal region each have a tooth-like configuration, said configurations co-operating to form a relative positive fit.

17. The combination of claim 1, including a sealing ring interposed between said marginal region and said closure, and wherein at least said closure is provided with at least one projection arranged to penetrate into said sealing ring when said rim is stressed by said stressing means.

18. The combination of claim 17, wherein a said projection is defined by at least one circumferential protruding strip.

19. The combination of claim 1, including a sealing ring interposed between said marginal region and said closure, and wherein at least said marginal region is provided with at least one projection arranged to penetrate into said sealing ring when said rim is stressed by said stressing means.

20. The combination of claim 19, wherein a said projection is defined by at least one circumferential protruding strip.

21. The combination of claim 1, including retaining means on said marginal region retaining said stressing means.

22. The combination of claim 21, wherein said retaining means is defined by bridge-like members and rear recesses behind which marginal regions of said stressing means engage.

23. The combination of claim 1, including retaining means on said rim retaining said stressing means.

24. The combination of claim 23, wherein said retaining means is defined by bridge-like members and rear recesses behind which marginal regions of said stressing means engage.

25. The combination of claim 24, wherein said bridge-like members are arranged in relatively axially displaced relationship.

26. The combination of claim 24, wherein said rim has a plurality of projections which are arranged in pairs and which are associated with a said bridge-like member which is disposed in a region of said rim thereabove, at least its lower terminal region extending loosely between the two projections of a said pair.

27. The combination of claim 26, wherein said rim has at least one incision and said projections of a said pair are arranged on either side of a said incision.

28. The combination of claim 1, wherein said lid portion on the one hand and said rim on the other hand are relatively separate parts, said rim having a continuous and integral extension which overlaps a boundary wall of said mouth and said rim at that one of its ends which faces away from said vessel.

29. The combination of claim 1, including a closure lever associated with said stressing band, said closure lever extending substantially radially from said rim when in an opened condition and being adapted to be suitable for use as a grip for engagement and disengagement of said interengageable projections and recesses.

30. The combination of claim 1, wherein even when said stressing means is opened, portions of said rim are somewhat prestressed radially inwardly.

31. The combination of claim 1, wherein said stressing means has structure for producing an inward radial stress on said sections of said rim and wherein said closure includes threads and said marginal region has threads mating therewith so structured that the closure is secured to said marginal region of said vessel initially by a short screwing movement and then finally secured by radially inwardly stressing said rim by means of said stressing means to engage said outwardly splayed sections with said vessel.

* * * * *